US005165293A

United States Patent [19]

Kittaka et al.

[11] Patent Number: 5,165,293

[45] Date of Patent: Nov. 24, 1992

[54] INTERMEDIATE GEAR TYPE STARTER

[75] Inventors: Yoshiaki Kittaka; Toshio Sakamoto, both of Hyogo, Japan

[73] Assignee: Mitsubishi Denki K.K., Tokyo, Japan

[21] Appl. No.: 775,087

[22] Filed: Oct. 11, 1991

[30] Foreign Application Priority Data

Oct. 25, 1990 [JP] Japan ..... 2-290470

[51] Int. Cl.[5] ..... F02N 15/06

[52] U.S. Cl. ..... 74/7 A; 74/7 E; 74/7 C

[58] Field of Search ..... 74/7 A, 7 E, 7 C

[56] References Cited

U.S. PATENT DOCUMENTS 4,604,907 8/1986 Morishita et al. ..... 74/7 E
4,974,463 12/1990 Luiki ..... 74/7 E

FOREIGN PATENT DOCUMENTS 58-84369 6/1983 Japan .
2-196163 8/1990 Japan .
140751 5/1921 United Kingdom .

OTHER PUBLICATIONS

Patent Abstracts of Japan, Abstract of Published Application No. 55-54665 to Nobutoshi Hasebe, Apr. 22, 1980.

Patent Abstracts of Japan, Abstract of Published Application No. 1-244163 to Isozumi Shuzo, Sep. 28, 1989.

*Primary Examiner*—Allan D. Herrmann
*Attorney, Agent, or Firm*—Sughrue, Mion, Zinn, Macpeak & Seas

[57] ABSTRACT

An intermediate gear type starter comprises a movable coupling body which is mounted on the intermediate shaft in such a manner as to slide together with the intermediate gear. The movable coupling body comprises: a locking portion which is engaged with the over-running clutch: and a cover portion for closing the opening formed on the internal combustion engine side. The over-running clutch is axially coupled to the intermediate gear through the movable coupling body.

4 Claims, 4 Drawing Sheets

INTERMEDIATE GEAR TYPE STARTER

BACKGROUND OF THE INVENTION

This invention relates to an intermediate gear type starter having an intermediate gear which is engaged with a pinion coupled to an electric motor and the ring gear of an internal combustion engine at the same time.

FIGS. 6 and 7 shows a conventional intermediate gear type starter disclosed, for instance, by Japanese Utility Model Unexamined Publication No. Sho. 58-84369. More specifically, FIG. 6 is a longitudinal sectional view showing essential components of the starter, and FIG. 7 is a sectional view showing the engagement of a shift ring.

In FIGS. 6 and 7, reference numeral 1 designates a DC motor. In the DC motor, an armature rotary shaft 3 is extended from its armature 2 in a forward direction (to the right in FIG. 6). A front bracket 5 coupled to the DC motor 1 supports the front end portion of the rotary shaft 3 through a sleeve bearing 6.

An over-running clutch 7 is slidably mounted on the rotary shaft 3. The over-running clutch 7 is designed as follows: That is, the over-running clutch 7 comprises; a clutch outer member 8 which is engaged with a helical spline gear formed on the rotary shaft 3 so that the rotation of the rotary shaft 3 is transmitted to the clutch outer; and a clutch inner member 9 for transmitting the rotation through rollers 10 to the clutch outer member 8 in one way. The clutch inner member 9 is mounted through a sleeve bearing 17 on the rotary shaft 13. The front end portion of the clutch inner member 9 is formed into a pinion 11. A clutch cover 12 is secured through a stiffening plate 13 to the clutch outer member 8 by staking. A locking ring 14 is fixedly mounted on the clutch outer member 8, thus forming an engaging groove 15 with the step of the clutch outer member 8. An eccentricity regulating ring 16 is secured to the inner cylindrical surface of the clutch outer member 8.

Further in FIG. 6, reference numeral 20 designates a fork-shaped shift lever the two prongs of which are engaged with the aforementioned engaging groove 15. It is supported, at its middle portion, namely, its fulcrum portion, by a receiving plate 21. The receiving plate 21 is supported through a shock absorbing spring 23 on a grommet 22 mounted on the housing of the motor 1. The other end portion of the shift lever 20 is coupled to the end portion of the plunger of an electromagnetic switch (not shown) mounted on the motor, so that the shift lever 20 is swung about its fulcrum portion.

Further in FIG. 6, reference numeral 24 designates an intermediate shaft which is secured to the front bracket 5 in such a manner as to be in parallel with the rotary shaft 3; 25, a grommet; 26, an intermediate gear supported by the intermediate shaft 24 through a sleeve bearing 28 which is secured to the inner wall of the intermediate gear. The intermediate gear 26 has a boss **26*a*, in the outer surface of which an annular groove 27 is formed. A shift ring 29 is secured to the outer cylindrical wall of the clutch cover 12. The shift ring 29 has an annular flange 29*a* protruded radially, which is engaged with the annular groove 27 in the boss 26*a* of the intermediate gear 26 as shown in FIG. 7**.

Now, the operation of the starter thus constructed will be described.

Upon energization of the exciting coil of the electromagnetic switch (not shown), the plunger is attracted, lo so that the shift lever 20 is turned counterclockwise to move the over-running clutch 7 in the forward direction (or in the direction of the arrow A) until the over-running clutch 7 strikes against the stopper 18 mounted on the rotary shaft 3. As the over-running clutch 7 is moved in this manner, the intermediate gear 26 is moved along the intermediate shaft 26 through the shift ring 29 until it is engaged with the ring gear 30 of the internal combustion engine. Thereafter, the stationary contact means of the electromagnetic switch is closed, so that current is applied to the circuit of the DC motor 1 to rotate the armature 2. The rotation of the rotary shaft 3 is transmitted through the over-running clutch 7, the pinion 11 and the intermediate gear 26 to the ring gear 30 of the internal combustion engine to start the latter.

As was described above, in the conventional intermediate gear type starter, the intermediate gear is moved in association with the over-running clutch 7. For this purpose, the shift ring 29 is fixedly secured to the over-running clutch 7. The force of movement of the over-running clutch 7 is applied to the intermediate gear through the annular flange **29*a* of the shift ring 29 engaged with the upper portion of the annular groove 27 of the intermediate gear 26; that is, the moment of the force acts on the intermediate gear 26**, thus obstructing the smooth axial movement of the intermediate gear.

In addition, the conventional intermediate gear type starter is disadvantageous in the following point: In providing lo a cover for the starter for dust-proof, corrosion-proof and water-proof, components of a cover, mounting bolts or the like are required, thus increasing the number of components.

SUMMARY OF THE INVENTION

Accordingly, an object of this invention is to eliminate the above-described difficulties accompanying a conventional intermediate gear type starter. More specifically, an object of the invention is to provide an intermediate gear type starter in which it is unnecessary to fixedly secure a particular component such as the shift ring to the over-running clutch, the intermediate gear can be smoothly moved in the axial direction, and the intermediate gear assembly can be built in it with ease even after the other components are assembled.

In order to achieve the foregoing object of the invention, the present invention provides an intermediate gear type starter comprising: an over-running clutch slidably mounted on an output shaft of the starter through a helical spline gear formed thereon; a pinion rotated only in one direction by the over-running clutch; an intermediate shaft arranged in parallel with the output shaft; an intermediate gear slidably mounted on the intermediate shaft, for transmitting the rotation of the pinion to a ring gear of an internal combustion engine; and a movable coupling body mounted on the intermediate shaft in such a manner as to slide together with the intermediate gear, the movable coupling body including a locking portion engaged with the over-running clutch for axially coupling the over-running clutch with the intermediate gear, and a cover portion for closing an opening formed on the internal combustion engine side.

The intermediate gear type starter according to the present invention may preferably further comprise a driving motor having an armature shaft; and a planetary speed reduction gear unit interposed between the armature shaft and the output shaft for transmitting the rotation of the armature shaft to the output shaft. However, the present invention should not be restricted thereto or thereby.

The intermediate gear type starter according to the present invention may preferably further comprise means for slidably moving the over-running clutch on the output shaft, having a shift lever engaged with an annular groove formed on the overrunning clutch, the locking portion being engaged with the annular groove.

In the starter of the invention, the locking portion and the cover portion are extended from the movable coupling body. This structure makes it unnecessary to provide particular means for engaging the over-running clutch with the intermediate gear in the axial direction or to provide means for installing the cover.

BRIEF DESCRIPTION OF THE DRAWINGS

In the accompanying drawings.

In those figures, like parts are designated by like reference numerals or characters.

DETAILED DESCRIPTION OF THE PREFERRED EMBODIMENTS

Preferred embodiments of this invention will now be described in detail with reference to the drawings attached hereto.

Figure 1:
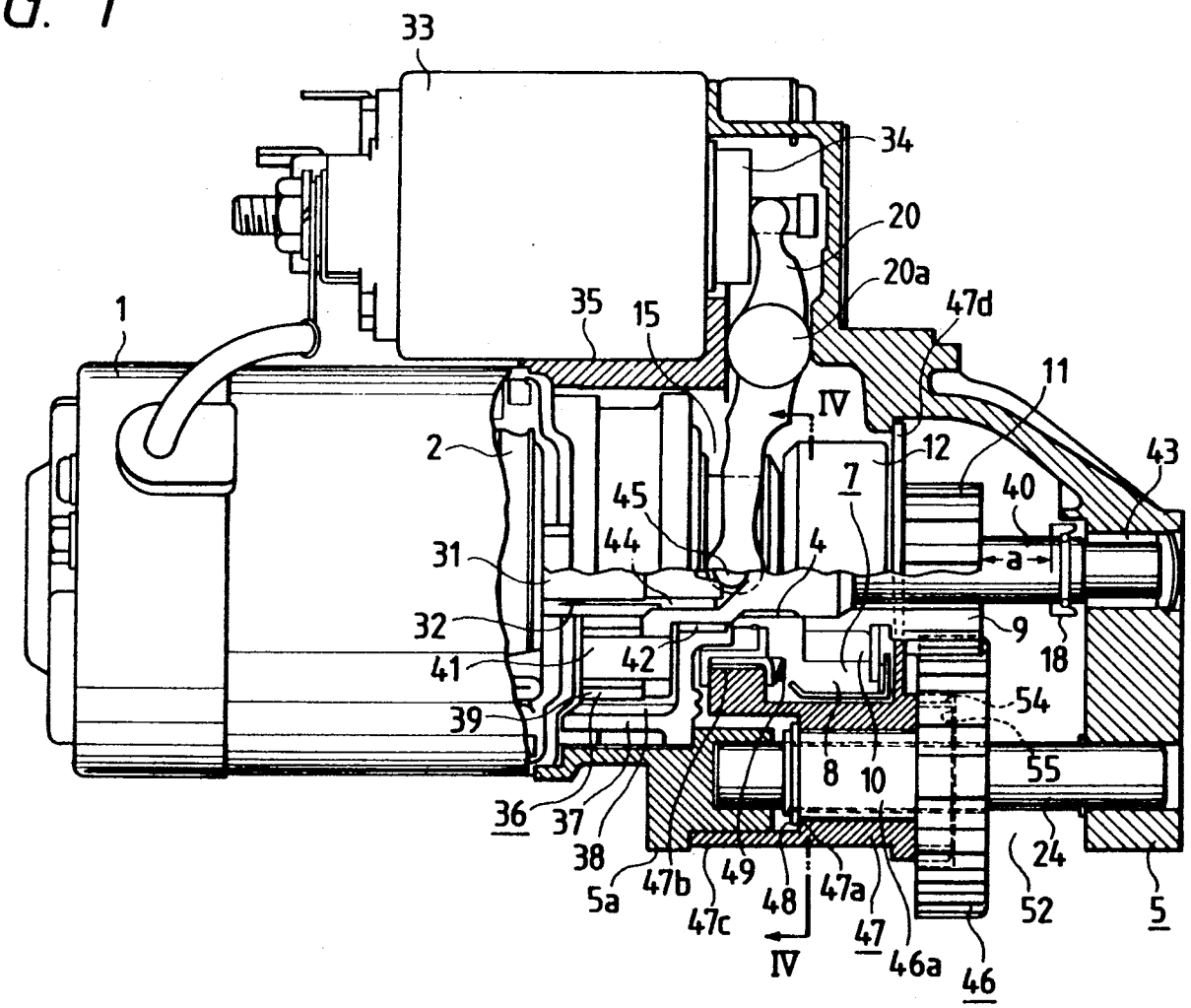
FIG. 1 is a side view, with parts cut away, showing essential components of an example of an intermediate gear type starter which constitutes an embodiment of this invention.
Figure 2:
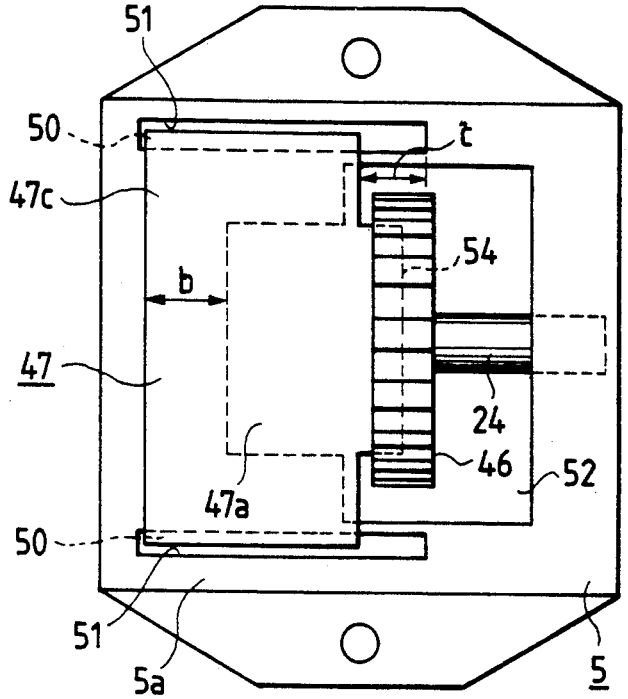
FIG. 2 is a bottom view showing essential components of the starter shown in FIG. 1.
Figure 3:
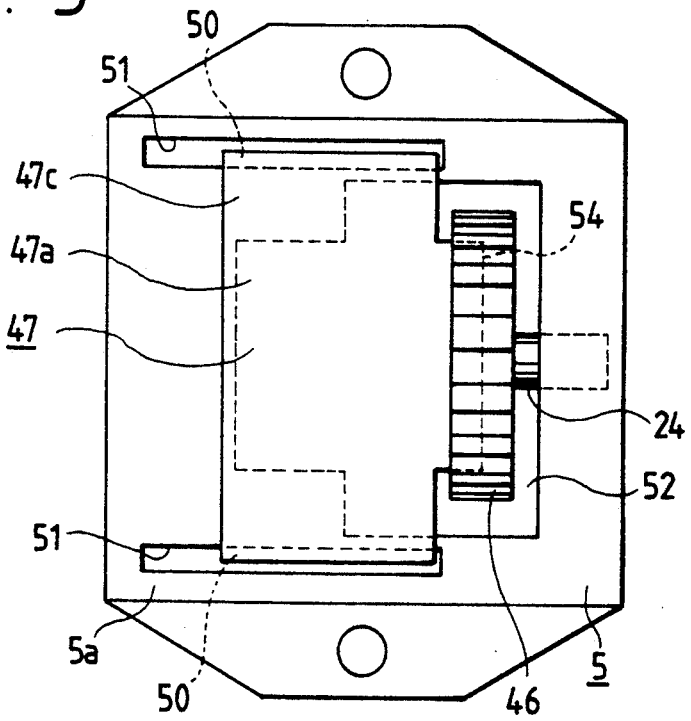
FIG. 3 is a bottom view corresponding to FIG. 2, showing an intermediate gear moved forwardly.
Figure 4:
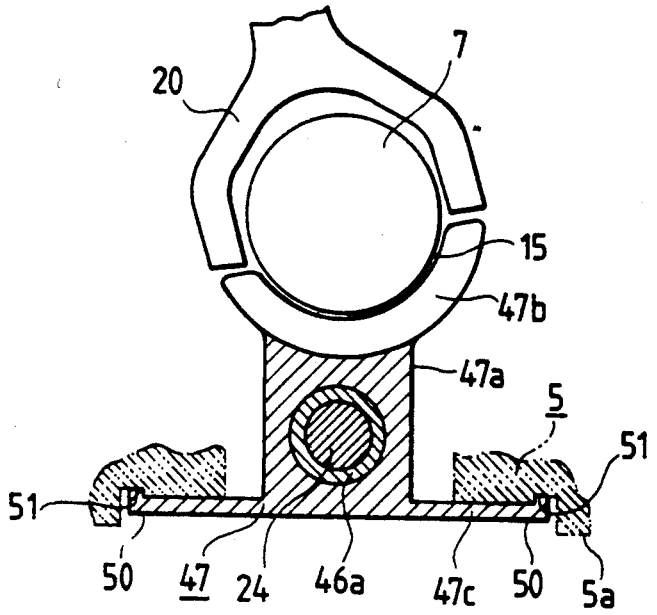
FIG. 4 is a sectional view taken along line IV—IV in FIG. 1.
Figure 5:
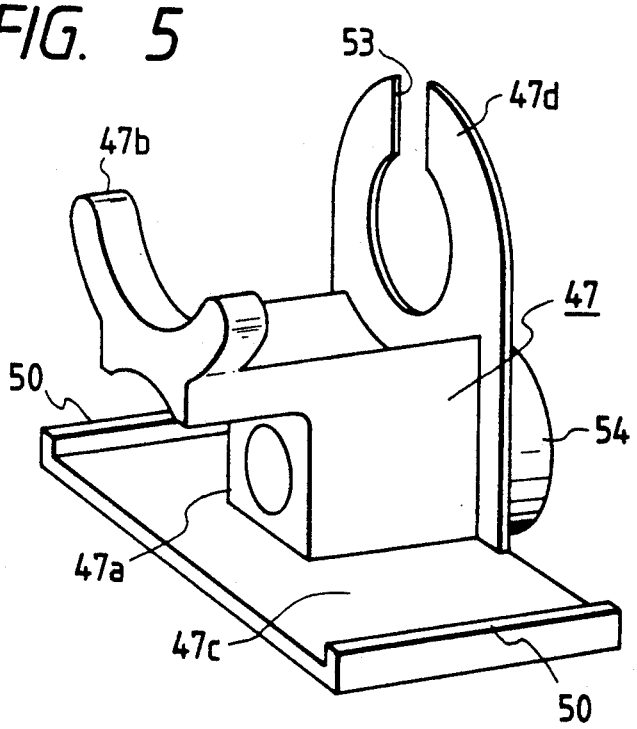
FIG. 5 is a perspective view showing a movable coupling body.
Figure 6:
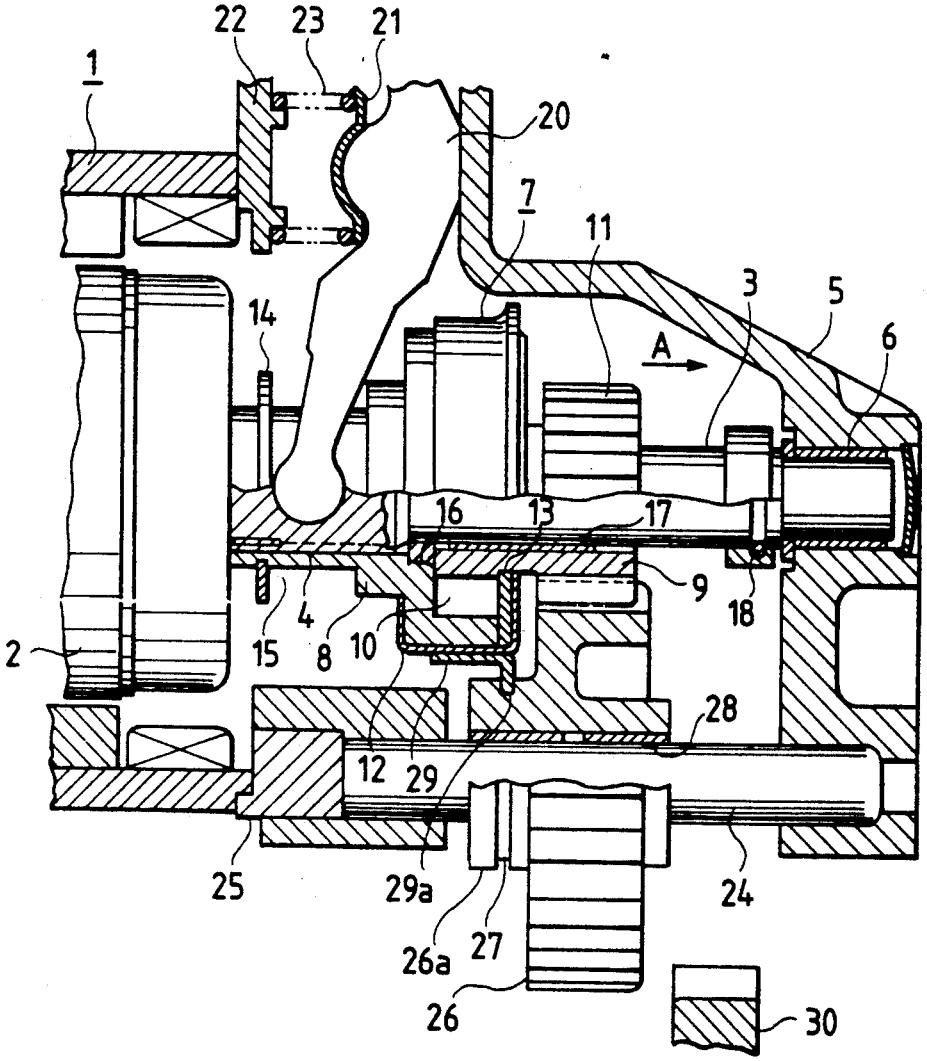
FIG. 6 PRIOR ART
FIG. 6 is a longitudinal sectional view showing essential components of a conventional intermediate gear type starter.
Figure 7:
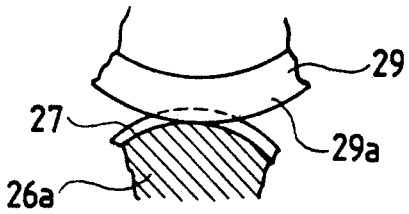
FIG. 7 PRIOR ART
FIG. 7 is a sectional view showing the engagement of a shift ring in the conventional starter.

FIG. 1 is a side view, the parts cut away, showing essential components of an example of an intermediate gear type starter according to the invention. FIG. 2 is a bottom view showing essential components of the starter shown in FIG. 1. FIG. 3 is a bottom view corresponding to FIG. 2, showing an intermediate gear moved forwardly. FIG. 4 is a sectional view taken along line IV—IV in FIG. 1. FIG. 5 is a perspective view showing a movable coupling body. In those figures, parts corresponding functionally to those which have been described with reference to FIGS. 6 and 7 are therefore designated by the same reference numerals or characters.

As shown in FIGS. 1 through 5, the front end portion of an armature rotary shaft 31 is formed into a pinion, namely, a sun gear 32. An electromagnetic switch 33 is mounted on a front bracket 5. The electromagnetic switch 33 includes a plunger 34, the front end portion of which is engaged with the upper end portion of a shift lever 20 in such a manner that the shift lever 20 is swung about its middle portion, namely, a fulcrum portion 20*a*. A rubber grommet 35 is fitted in the front bracket 5 to support the fulcrum portion 20*a* of the shift lever 20.

Further in those figures, a planetary speed reduction gear unit 36 is designed as follows: An internal gear frame 37 having an internal gear 38 is fixedly fitted in the front bracket 5. A plurality of planet gears 39 are engaged with the sun gear 32 in such a manner that they revolve around the sun gear while rotating themselves, being mounted through bearings (not shown) on support pins 41 embedded in an output shaft 41. That is, the speed of rotation of the output shaft 40 is reduced by the revolution of the planet gears 39. The rear end portion of the output shaft 40 is supported through a bearing 42 by the internal gear frame 37, whereas the front end portion is supported through a sleeve bearing 43 by the front bracket 5. A helical spline gear (not shown) is formed on the output shaft's rear end portion near the rear end. The front end portion of the armature rotary shaft 31 is engaged through a bearing 44 with a hole formed in the rear end of the output shaft 40, with a steel ball 45 held in the hole in such a manner that it is interposed between the armature rotary shaft and the output shaft.

An intermediate gear 46 is rotatably and slidably mounted on an intermediate shaft 24. A movable coupling body 47 is loosely put on the boss 46*a* of the intermediate gear 46; however the removal of the movable coupling body 47 from the boss is prevented by a retain ring 48.

As shown in FIGS. 4 and 5, the movable coupling body 47 comprises: a boss portion 47*a*; and an arcuate locking portion 47*b*, a cover portion 47*c* and a spatula portion 47 which are protruded from the boss portion 47*a*. The movable coupling body 47 is made of a synthetic resin material great in mechanical strength; however, it may be made of metal as the case may be. The arcuate locking portion 47*b* of the movable coupling body 47 is inserted into the engaging groove 15 of the over-running clutch 7 from below until it confronts with the two prongs of the shift lever 20. The arcuate locking portion 47*b* is pushed through a conical spring washer 49 so that it may not play in the thrust direction. The cover portion 47*c* has protrusions 50 extended from its both edges. The protrusions 50 are engaged with two grooves 51 formed in the mounting surface 5*a* of the front bracket 5 so as to guide the sliding of the movable coupling body 47. The protrusions 50 and grooves 51 thus engaged form labyrinth structures. The dimensions of the cover portion 47*c* are as follows: $a<b$, and $a<c$. Hence, the provision of the cover portion 47 makes it possible to minimize the area of the opening 52 on the engine side, and to prevent the entrance of water or the like. The spatula portion 47*d* has a cut 53 in the end portion The spatula portion 47*d* is inserted between the pinion 11 and the clutch cover 12 by utilizing the cut 53, whereby the entrance of water into the clutch is minimized when the intermediate gear 46 is at the rest position. It is not always necessary to form the cut 53 in the end portion of the spatula portion 47*d*. The front end portion 54 of the boss portion 47*a* is inserted into a groove 55 formed in the intermediate gear 46. The front end portion 54 and groove 55 thus engaged form a labyrinth structure.

The over-running clutch 7 is mounted on the output shaft 40.

The boss 46*a* of the intermediate gear 46 is inserted into the boss portion 47*a* of the movable coupling body 47. As the shift lever 20 is turned, the over-running clutch 7 is moved axially, and accordingly the movable coupling body 47 is moved in association with the over-running clutch 7, thus moving the intermediate gear 46. However, in this operation, owing to the above-described structure, no moment acts on the intermediate gear 46; that is, the intermediate gear 46 is moved smoothly.

Upon energization of the electromagnetic switch 33, the shift lever 20 is turned counterclockwise, to move the over-running clutch 7 in the forward direction. The movable coupling body 47 is operated in association with the movement of the over-running clutch 7, to move the intermediate gear 46 in the forward direction until the intermediate gear 46 is engaged with the ring gear (not shown) of the engine. At the same time, the stationary contact means of the electromagnetic switch 33 is closed, so that current is applied to the circuit of the DC motor 1, to rotate the armature rotary shaft 31. The rotation of the armature rotary shaft 31 is transmitted through the planetary speed reduction gear unit 36 to the output shaft 40. As a result, the output shaft 40 is rotated at a reduced speed. The rotation of the output shaft 40 is transmitted through the over-running clutch 7 and the intermediate gear 46 to the ring gear, to rotate the latter. Thus, the combustion engine is started.

In the above-described embodiment, the planetary speed reduction gear unit 36 is interposed between the armature rotary shaft and the output shaft; however, the invention is not limited thereto or thereby. That is, the technical concept of the invention can be applied to an intermediate gear type starter which, as in the conventional intermediate gear type starter, has no planetary speed reduction gear unit with the armature rotary shaft extended to the front bracket.

As is apparent from the above description, in the intermediate gear type starter according to the invention, a conventional ordinary over-running clutch can be used with no components secured thereto, and the intermediate gear is smoothly movable in the axial direction. Furthermore, in the starter of the invention, since the cover portion is extended from the movable coupling body, the number of components for installation of the cover is reduced as much. In addition, after the starter is assembled, the intermediate gear assembly can be built in it with ease. The entrance of water into the starter from the engine side can be minimized.

What is claimed is:

1. An intermediate gear type starter comprising:

an over-running clutch slidably mounted on an output shaft of said starter through a helical spline gear formed thereon;

a pinion rotated only in one direction by said over-running clutch;

an intermediate shaft arranged in parallel with said output shaft;

an intermediate gear slidably mounted on said intermediate shaft, for transmitting the rotation of said pinion to a ring gear of an internal combustion engine; and a movable coupling body mounted on said intermediate shaft in such a manner as to slide together with said intermediate gear, said movable coupling body including, a locking portion engaged with said over-running clutch for axially coupling said over-running clutch with said intermediate gear, and a cover portion for closing an opening formed on the internal combustion engine side.

2. The intermediate gear type starter according to claim 1, further comprising:

a driving motor having an armature shaft; and a planetary speed reduction gear unit interposed between said armature shaft and said output shaft for transmitting the rotation of said armature shaft to said output shaft.

3. The intermediate gear type starter according to claim 1, further comprising:

means for slidably moving said over-running clutch on said output shaft, having a shift lever engaged with an annular groove formed on said over-running clutch, and wherein said locking portion is engaged with said annular groove.

4. The intermediate gear type starter according to claim 1, wherein said movable coupling body further includes a spatula portion inserted between said pinion and said over-running clutch.

* * * * *